US005189816A

United States Patent [19]

Shibata

[11] Patent Number: 5,189,816

[45] Date of Patent: Mar. 2, 1993

[54] MID-SOLE OR SOLE OF SHOES

[75] Inventor: Osamu Shibata, Tokyo, Japan

[73] Assignee: Kabushiki Kaisha Himiko, Tokyo, Japan

[21] Appl. No.: 820,381

[22] Filed: Oct. 24, 1991

[30] Foreign Application Priority Data

Nov. 22, 1990 [JP] Japan ..... 2-316195
Apr. 25, 1991 [JP] Japan ..... 3-121943

[51] Int. Cl.[5] ..... A43B 13/18; A43B 13/20; A43B 13/38

[52] U.S. Cl. ..... 36/28; 36/29; 36/43; 36/141

[58] Field of Search ..... 36/25 R, 28, 29, 43, 36/141

[56] References Cited

U.S. PATENT DOCUMENTS

| | | | |
|---|---|---|---|
| 1,539,283 | 5/1925 | Staats-oels | 36/28 |
| 2,968,105 | 1/1961 | Rizzo | 36/29 |
| 3,087,262 | 4/1963 | Russell | 36/28 |
| 4,075,772 | 2/1978 | Sicurella | 36/43 |
| 4,845,861 | 7/1989 | Moumdjian | 36/29 |
| 4,864,737 | 9/1989 | Marrello | 36/28 |
| 4,934,070 | 6/1990 | Mauger | 36/28 |
| 4,934,071 | 6/1990 | Virgini | 36/29 |

FOREIGN PATENT DOCUMENTS

| | | | |
|---|---|---|---|
| 539530 | 2/1956 | Italy | 36/28 |
| 2152797 | 8/1985 | United Kingdom | 36/28 |

*Primary Examiner*—Paul T. Sewell
*Assistant Examiner*—M. P. Patterson
*Attorney, Agent, or Firm*—Jordan and Hamburg

[57] ABSTRACT

A mid-sole or sole of shoes for massaging the sole of a foot by stimulating it during walking includes recess portions on the upper surface of a bottom plate defined by a wall portion, a plurality of blades in the recess portions extending in a direction perpendicular to the longitudinal direction of the bottom plate and being slanted in the same direction, a flexible cover sealed at the peripheral end portion of the upper surface of the bottom plate, and liquid injected and filled in the space provided between the bottom plate and the cover.

10 Claims, 3 Drawing Sheets

MID-SOLE OR SOLE OF SHOES

SUMMARY OF THE INVENTION

The mid-sole or sole of shoes of the present invention comprises a bottom plate having a configuration similar to a shoes's sole and recess portions formed by walls on the upper surface thereof; a plurality of blades mounted within the recess portions of the bottom plate respectively extend in a direction perpendicular to the longitudinal direction of the bottom plate so as to be slanted in the same direction, and having the same thickness as that of the recess portion; a flexible cover sealed at the periphery of the upper surface of the bottom plate; liquid injected and filled into the sealed space provided between the bottom plate and the cover; webs for connecting both ends of the blade to the inner portion of the wall portion of the bottom plate; and notches mounted at the intermediate portion of the blades respectively, having the size to allow the flow of the liquid.

BACKGROUND OF THE INVENTION

The present invention relates to a mid-sole or sole of shoes having a massage effect due to stimulating of the sole of a foot.

Hitherto, there was mid-sole and sole of shoes in which two sheets are sealed at the peripheral edge portion thereof to form a hollow portion therein and liquid is injected and filled in the hollow portion. According to such shoes, when one walks, the liquid moves within the hollow portion in the sheets due to the pressure of one's foot because of the movement of one's weight.

In such mid-sole of shoes, the liquid moves in a voluntary direction thereby causing a seasickness phenomenon thereby to bring feeling of fatigue. Moreover, the liquid sometimes leaks from the mid-sole to the exterior as lapse of time.

The object of the present invention is to give direction to the liquid and to move the liquid in a predetermined direction by the movement of weight thereby stimulating the entire sole of foot.

The other object of the present invention is to prevent the liquid from leaking out of the mid-sole or sole of shoes.

The feature of the present invention resides in a bottom plate, a plurality of blades formed on the bottom plate, a cover sealed at the peripheral edge portion of the bottom plate, liquid filled in the hollow portion provided between the bottom plate and the cover, webs provided at both ends of the blade, and notches formed on the blades.

The configuration of the bottom plate is similar to that of the sole of shoes and there are provided a plurality of recess portions on the upper surface by wall portions, and the bottom plate is made of thermoplastic polyvinyl. There is provided a thin portion through an offset at the periphery of the wall portion.

There are integrally provided a plurality of blades within the recess portions respectively extending in a direction perpendicular to the longitudinal direction of the bottom plate, and the blades are slanted in the same direction and have approximately the same thickness as the depth of the recess portion.

Both ends of each of the respective blades are connected to the inner portion of the wall portion of the bottom plate through the webs. There is provided a notch portion at the intermediate portion of each blade and its size is set such that the liquid may move.

A flexible cover is sealed at the edge portion of the upper surface of the bottom plate, and the cover is favorably made of the same material as that of the bottom plate. There is provided a thick portion through the offset at the periphery of the cover. The thin portion of the bottom plate adheres to the thick portion provided on the cover.

Liquid such as water is injected and filled in the space provided between the bottom plate and the cover.

According to the present invention thus constructed, the liquid mainly moves in the gap provided between blades reciprocally, and further in a direction perpendicular to the longitudinal direction of the blades through the webs and the notches reciprocally.

DETAILED DESCRIPTION OF THE PREFERRED EMBODIMENTS

Figure 1:
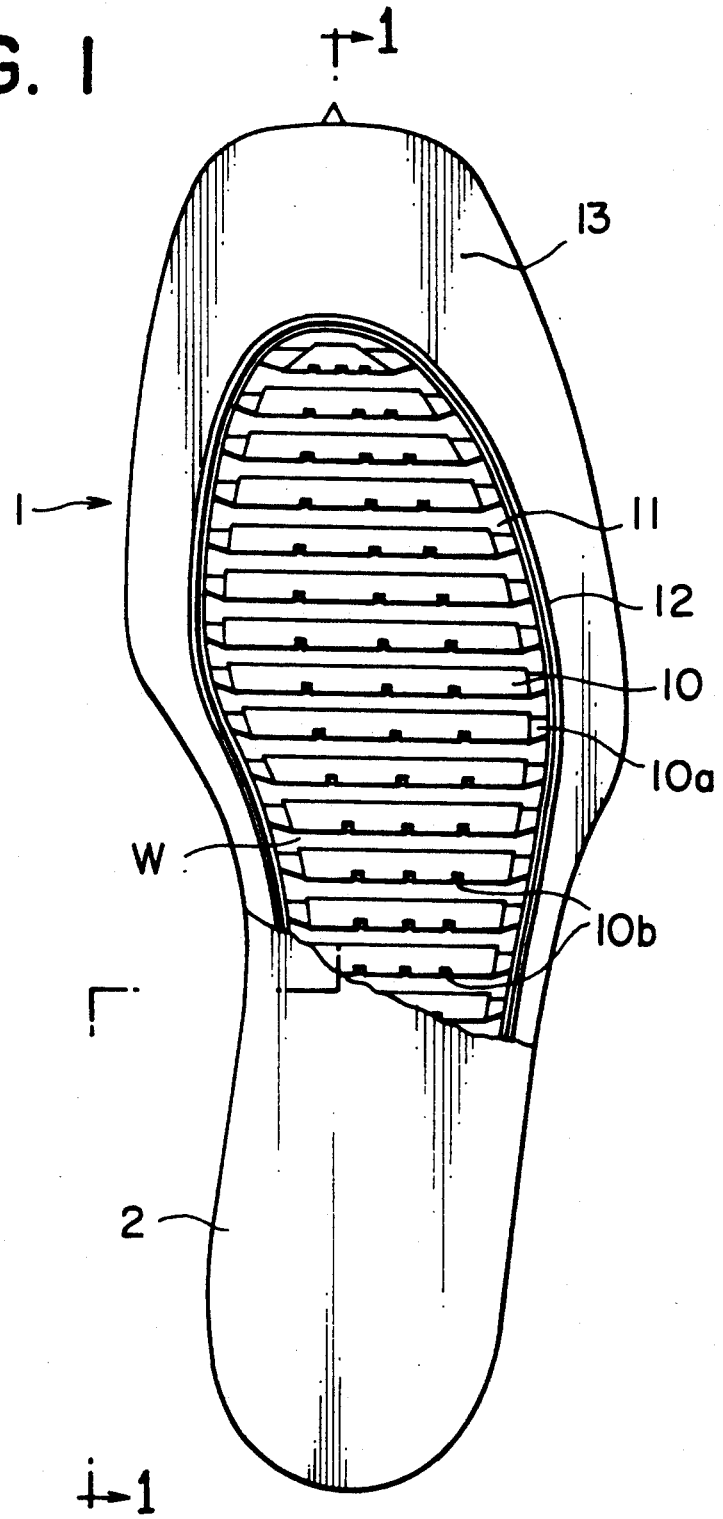
FIG. 1 is a partially broken front view showing mid-sole or sole of shoes.

Referring now to the drawings, embodiments of the present invention applied to a mid-sole of shoes are described hereinafter.

Figure 2:
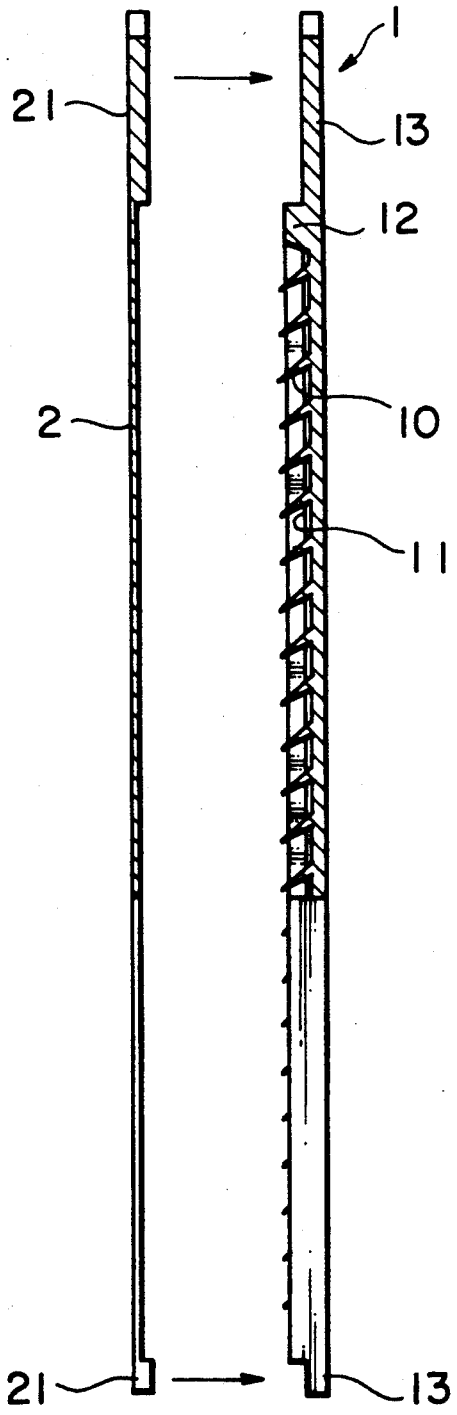
FIG. 2 is a sectional view taken along the line a—a of FIG. 1.

Referring to FIGS. 1 and 2, the mid-sole of shoes in composed of a bottom plate 1 having the configuration similar to that of the sole of shoes, a cover 2 sealed at the periphery of the bottom plate, a plurality of blades 10 integrally formed with the bottom plate, and liquid such as water injected into the space provided between the bottom plate and the cover.

The bottom plate 1 is made of polyvinyl chloride such as thermoplastic resin, and the bottom plate 1 has a configuration similar to that of the sole of shoes as shown in FIG. 1. There are provided a plurality of recess portions 11 on the upper surface of the bottom plate within the area corresponding to the sole of a foot, and these recess portions are enclosed by wall portion 12. The above half portion of the bottom plate 1 is made as a wide portion, and therefore it is possible to adjustably cut a part of the above half portion in accordance with the size of shoes. The above half portion corresponds to a thin portion 13 of the bottom plate 1 and a thick portion 21 of the cover 2.

The thin portion 13 is provided at the periphery of the wall portion 12 of the bottom plate 1 through an offset as shown in FIG. 2, and the thin portion 13 is made thin in comparison with the thickness of the wall portion 12.

Figure 3:
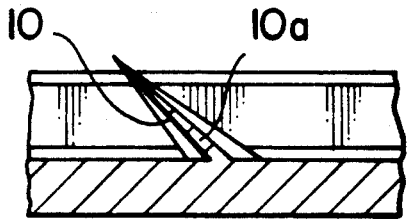
FIG. 3 is an enlarged sectional view of the blade.
Figure 4:
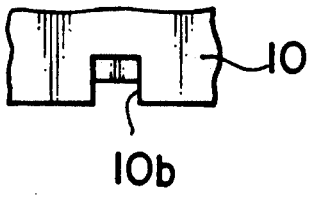
FIG. 4 is an enlarged front view showing notches.

There are provided a plurality of blades 10 on the upper surface of the bottom surface of the recess portion 11 integrally with the bottom plate 1, and a plurality of webs 10*a* connected to the inner portion of the wall portion 12 of the bottom plate 1. As shown in FIG. 3, the web 10*a* is made thinner and lower than the blade 10 thereby making possible the water W to be moved past the web.

Each of the blade 10 is formed in the direction (the horizontal direction in FIG. 1) perpendicular to the longitudinal direction of the bottom plate 1, and as shown in FIG. 2, slanted in a predetermined same direction, i.e. toward the heel, and further the height of the blade is higher than that of the wall portion. Moreover, there are provided three notches 10*b* on the intermediate portion of each blade and the size of each notch is set so as to allow the passing of water W easily.

The flexible cover 2 is sealed at the peripheral portion of the bottom plate 1 by using a high frequency heating method. The cover 2 is made of polyvinyle chloride as similar to the bottom plate 1 and there is provided a thick portion 21 through an offset portion at the periphery thereof. The thick portion 21 is made thick rather than the thickness of the cover 2 and the thickness of the thick portion 21 is approximately same as that of the thin portion 13 of the bottom plate 1.

When the cover 2 is sealed at the peripheral edge portion of the bottom plate 1 by using a high frequency heating means, a sealed hollow portion is provided within the space enclosed by the bottom plate 1 and the cover 2. Water W is injected into the hollow portion from an injection inlet (not shown) mounted at the surface between thin portion 13 of the bottom plate 1 and the thick portion 21 of the cover 2.

As mentioned above, the thin portion 13 of the bottom plate 1 is offset with respect to the periphery of the wall portion 12, and further the thick portion 21 of the cover 2 is offset with respect to the cover 2, and therefore if the thin portion and the thick portion are sealed, both become an integral body since the bottom plate is made of the same material as that of the cover. The adherence area between the thin portion of the bottom plate and the thick portion of the cover is wide, and therefore a strong adherence force can be obtained.

Therefore, each of the blades 10 and the webs 10*a* is collapsed by the movement of the walker's weight, and the water W moves in the horizontal direction of FIG. 1 and further in the direction perpendicular to the longitudinal direction of the blades, i.e. the vertical direction in FIG. 1. Moreover, since the liquid is bent easily by means of the provision of the notches 10*b*, the movement of the liquid is effected smoothly, and further since the liquid moves in a predetermined direction, the massage effect for the sole of a foot is increased.

What is claimed is:

1. A sole of shoes comprising:

an elongated bottom plate having a longitudinal axis, said bottom plate having a wall portion defining a recess in said bottom plate, said bottom plate having a peripheral edge portion;

a plurality of elongated blades disposed in said recess and having longitudinal axes extending generally perpendicular to said longitudinal axis of said bottom plate, said blades being slanted relative to said bottom plate, said blades having longitudinal ends;

a cover sealed to said peripheral edge portion of said bottom plate to thereby define a sealed enclosure between said bottom plate and said cover;

said blades having an initial unflexed height greater that the depth of said recess such that said blades have upper edge portions which extend beyond said wall portion which define said recess when said blades are in said initial unflexed state;

webs connecting said longitudinal ends of said blades to said wall portion of said bottom plate, said webs having a height less than said height of said blades;

said blades having notches opening up onto said upper edge portions of said blades and extending partially into said blades so as to have a height less than the height of said blades; and liquid means in said sealed enclosure and operable to provide a massaging effect to a person who walks with said shoes as said liquid means passes back and forth through said notches and past the free ends of said blades and said webs.

2. A sole of shoes according to claim 1, wherein said blades have a bottom side joined to said bottom plate, said notches having a bottom terminating end spaced from said bottom side of said blades.

3. A sole of shoes according to claim 1, wherein said blades have a tapered cross-sectional configuration with the thickness of said blades progressively diminishing as the outer terminating ends of the blades are approached.

4. A sole of shoes according to claim 1, wherein said webs have a thickness less than the thickness of said blades.

5. A sole of shoes according to claim 1, wherein said webs are formed as longitudinal end extensions of said blades, said webs having a thickness less than the thickness of said blades.

6. A sole of shoes according to claim 1, wherein said wall portion of said bottom plate has a wall thickness greater than the thickness of said peripheral edge portion of said bottom plate, said cover having a main portion which overlies said recess in said bottom plate and a peripheral section disposed about said main portion, said peripheral section having a thickness greater than the thickness of said main portion with the difference in thickness between said main portion and said peripheral section being substantially the same as the difference between the thickness of said wall portion and the thickness of said peripheral edge portion of said bottom plate.

7. A sole of shoes according to claim 1, wherein said bottom plate and said cover are made of a thermoplastic resin material.

8. A sole of shoes according to claim 1, wherein said elongated bottom plate and said cover are made of a thermoplastic resin, said cover having a peripheral edge portion, said peripheral edge portion of said bottom plate around said recess thereof having substantially the same thickness as said peripheral edge portion of said cover, said peripheral edge portions of said bottom plate and said cover being fusedly joined together by high frequency heating, thereby sealing the space defined by said cover and said recess of said bottom plate.

9. A sole of shoes comprising:

an elongated bottom plate having a longitudinal axis, said bottom plate having a wall portion defining a recess in said bottom plate, said bottom plate having a peripheral edge portion;

a plurality of elongated blades disposed in said recess and having longitudinal axes extending generally perpendicular to said longitudinal axis of said bottom plate, said blades being slanted relative to said bottom plate, said blades having longitudinal ends;

a cover sealed to said peripheral edge portion of said bottom plate to thereby define a sealed enclosure between said bottom plate and said cover;

said blades having an initial unflexed height greater that the depth of said recess such that said blades have upper edge portions which extend beyond said wall portion which define said recess when said blades are in said initial unflexed state;

webs connecting said longitudinal ends of said blades to said wall portion of said bottom plate;

said blades having notches opening up onto said upper edge portions of said blades and extending partially into said blades so as to have a height less than the height of said blades; and liquid means in said sealed enclosure and operable to provide a massaging effect to a person who walks with said shoes as said liquid means passes through said notches.

10. A sole of shoes comprising:

an elongated bottom plate having a longitudinal axis, said bottom plate having a wall portion defining a recess in said bottom plate, said bottom plate having a peripheral edge portion;

a plurality of elongated blades disposed in said recess and having longitudinal axes extending generally perpendicular to said longitudinal axis of said bottom plate, said blades being slanted relative to said bottom plate, said blades having longitudinal ends;

a cover sealed to said peripheral edge portion of said bottom plate to thereby define a sealed enclosure between said bottom plate and said cover;

webs connecting said longitudinal ends of said blades to said wall portion of said bottom plate, said webs having a height less than said height of said blades;

said blades having notches opening up onto said upper edge portions of said blades and extending partially into said blades so as to have a height less than the height of said blades; and liquid means in said sealed enclosure and operable to provide a massaging effect to a person who walks with said shoes as said liquid means passes through said notches and past said webs.

* * * * *

UNITED STATES PATENT AND TRADEMARK OFFICE

CERTIFICATE OF CORRECTION

PATENT NO. : 5,189,816

DATED : March 2, 1993

INVENTOR(S) : Osamu Shibata

It is certified that error appears in the above-identified patent and that said Letters Patent is hereby corrected as shown below:

On the Title page, item [21], under Appl. No., change the Serial No. from "820,381" to --07/782,038--.

Signed and Sealed this

Thirtieth Day of November, 1993

*Attest:*

*Attesting Officer*

BRUCE LEHMAN

*Commissioner of Patents and Trademarks*